United States Patent [19]

Sakai et al.

[11] 3,967,373

[45] July 6, 1976

[54] OUTER BLADE FOR ELECTRIC SHAVER

[75] Inventors: Satoshi Sakai, Hirakata; Norio Shimizu, Neyagawa; Junji Nomura, Takatsuki, all of Japan

[73] Assignee: Matsushita Electric Works, Ltd., Osaka, Japan

[22] Filed: Mar. 20, 1974

[21] Appl. No.: 453,042

[30] Foreign Application Priority Data

Mar. 22, 1973 Japan ..... 48-32859
Mar. 22, 1973 Japan ..... 48-32860

[52] U.S. Cl. ..... 30/43.92; 30/346.51
[51] Int. Cl.[2] ..... B26B 19/04
[58] Field of Search ..... 30/346.51, 43.91, 43.92; D95/3 A, 3 B

[56] References Cited

UNITED STATES PATENTS

| | | | |
|---|---|---|---|
| 3,696,508 | 10/1972 | Messinger | 30/346.51 X |
| 3,815,232 | 6/1974 | Liska | 30/346.51 |

FOREIGN PATENTS OR APPLICATIONS

| | | | |
|---|---|---|---|
| 961,649 | 5/1950 | France | 30/346.51 |
| 1,113,066 | 3/1956 | France | 30/346.51 |

*Primary Examiner*—Al Lawrence Smith
*Assistant Examiner*—Gary L. Smith
*Attorney, Agent, or Firm*—Leydig, Voit, Osann, Mayer & Holt, Ltd.

[57] ABSTRACT

A net-shaped outer blade for reciprocating type electric shaver having an improved new pattern of hair inlet holes is provided. In a metal lamina as the outer blade body, a number of hair inlet holes including slit-shaped and round-shaped types is formed between adjacent ones of a plurality of ribs which are spaced at a proper interval with continuously varying spacing. The length dimension of the hair inlet holes is varied thus depending on the varying spacing between the ribs, and their lengthwise direction is made the same with each other. The area of the respective holes is advantageously made substantially equal to one another.

10 Claims, 17 Drawing Figures

OUTER BLADE FOR ELECTRIC SHAVER

This invention relates to improvements in net-shaped outer blades for reciprocating type electric shavers.

There are known conventional net-shaped outer blades for reciprocating type electric shavers wherein hair inlet holes are of the type of many round holes 21 arranged as illustrated in FIG. 1, or of diamond-shaped holes 23 arranged around hexagonal holes 22 as illustrated in FIG. 2.

However, in such convention blades, there have been such defects that, in the case of only the round holes illustrated in FIG. 1, it will be difficult to introduce long hairs and that; in the case of the type shown in FIG. 2, the direction of the slit (or hair inlet hole) will not be fixed, the hair holding angle (between the inner blade and the inside edge of the slit) at the time of cutting a hair introduced into the slit will not be constant and, therefore, the cutting efficiency will fluctuate with the direction of the slit and troubles will be caused.

In view of the above, the present invention has been suggested to remove such defects of the conventional outer blades, by providing in a metal lamina a pluraity of ribs sequentially varying in the spacings between them as spaced at proper intervals and also a plurality of slit-shaped hair inlet holes different in the length dimensions with a continuous expansion between the adjacent ones of the ribs.

An object of the present invention is, therefore, to provide an outer blade for electric shavers wherein hairs of different lengths can be efficiently introduced into the hair inlet holes.

Another object of the present invention is to provide an outer blade for electric shavers which is of a uniform high cutting efficiency on the entire surface.

Another object of the present invention is to provide an outer blade for electric shavers which is high in the opening rate.

A further object of the present invention is to provide an outer blade for electric shavers which is high in the strength in the central part of the blade.

Now the present invention shall be explained with reference to preferred embodiments in conjunction with accompanying drawings, in which.

Figure 4:
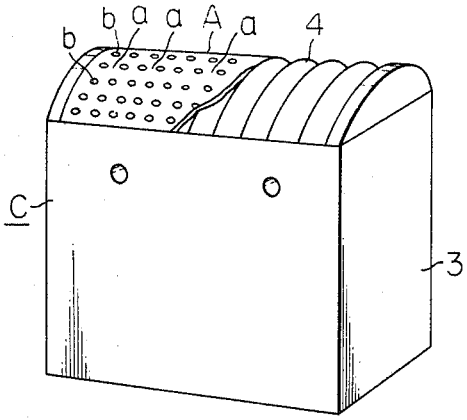
FIG. 4 is a perspective view of a reciprocating type electric shaver with a part removed, using the net-shaped outer blade illustrated in FIG. 3.

In the drawings, A is a net-shaped outer blade formed so as to be provided with a plurality of wavy ribs *a* continuously varying in the spacings between them at proper intervals on such metal lamina 1 as of a stainless steel and with a plurality of hair introducing holes or slots *b* at proper intervals so that the slots adjacent to each other in their lengthwise direction may not be continuous to each other between the adjacent ones of the wavy ribs *a*, the surface area of each hole being made substantially constant. Through fitting holes 2 made on the end edges of said lamina, as shown in FIG. 4, said outer blade is set arcuately on the upper surface of a reciprocating inner blade 4 arranged in the head part of a body 3 containing a driving source so as to be in sliding contact with said inner blade so that a reciprocating type electric shaver C will be formed.

The above described hair inlet holes *b* may be formed by either such mechanical process as punching or such chemical process as corrosion.

Figure 1:
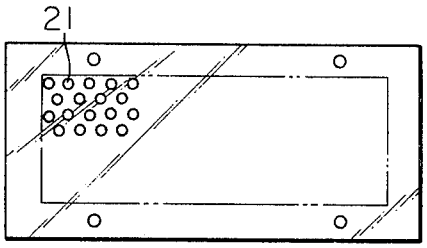
Fig. 1 (PRIOR ART)
FIGS. 1 and 2 are plan views of conventional net-shaped outer blades.
Figure 2:
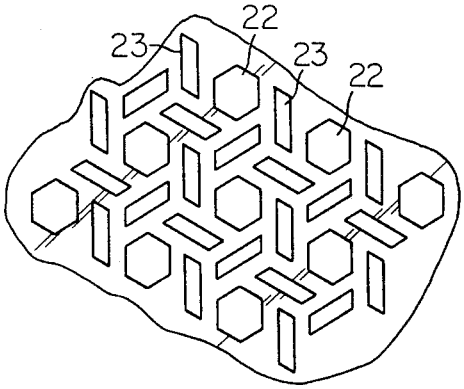
Fig. 2 (PRIOR ART)
Figure 3:
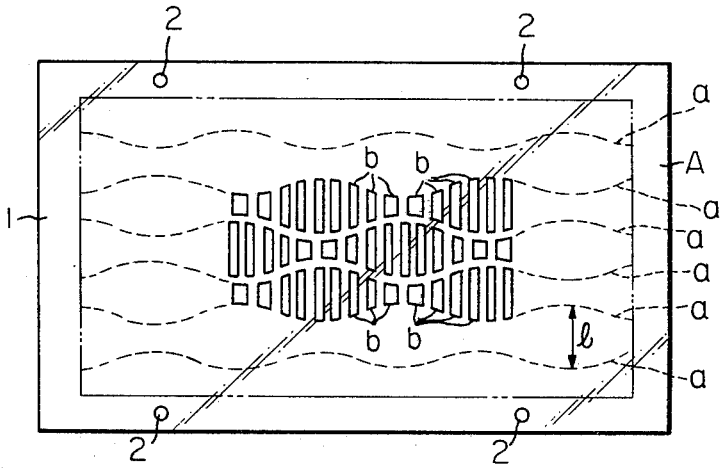
FIG. 3 is a plan view of a net-shaped outer blade according to the present invention.
Figure 5:
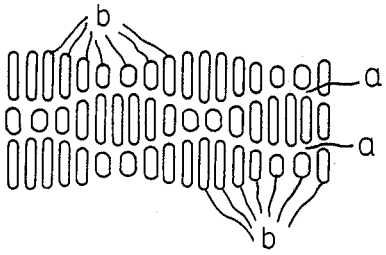
FIGS. 5 to 7 are plan views showing different embodiments of the net-shaped outer blade according to the present invention.
Figure 6:
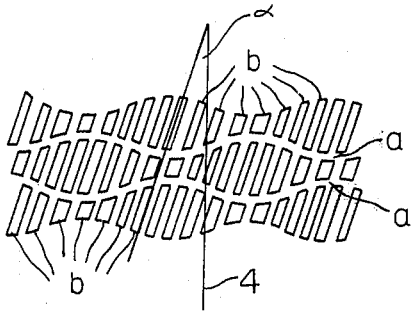
Figure 7:
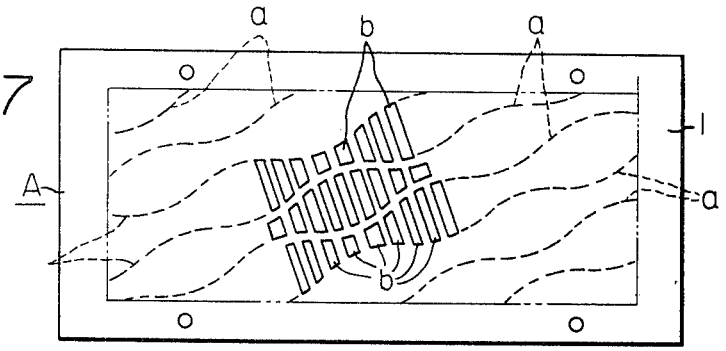

FIGS. 5 to 7 show different embodiments of the net-shaped outer blade according to the present invention. FIG. 5 is of an embodiment wherein both ends of the hair inlet hole *b* of the embodiment illustrated in FIG. 3 are formed to be arcuate. FIG. 6 is of an embodiment wherein the hair inlet holes *b* are formed to be inclined to provide the hair holding angle with respect to the reciprocating inner blade. FIG. 7 shows an embodiment wherein the wavy ribs *a* themselves are inclined relative to the end edges of the outer blade so as to provide the hair holding angle with respect to the reciprocating inner blade.

Figure 8:
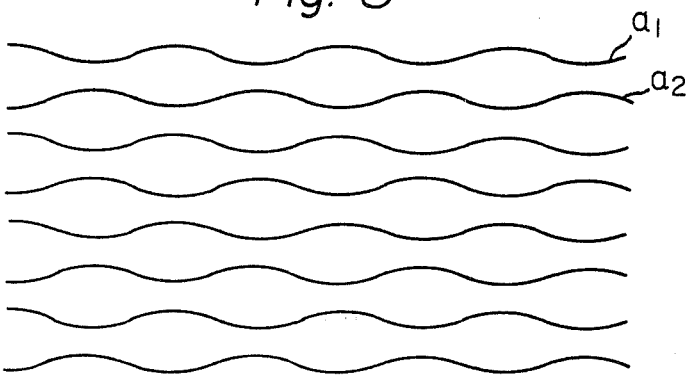
FIGS. 8 to 17 are explanatory views showing modified embodiments of the wavy ribs of the net-shaped outer blade according to the present invention.
Figure 9:
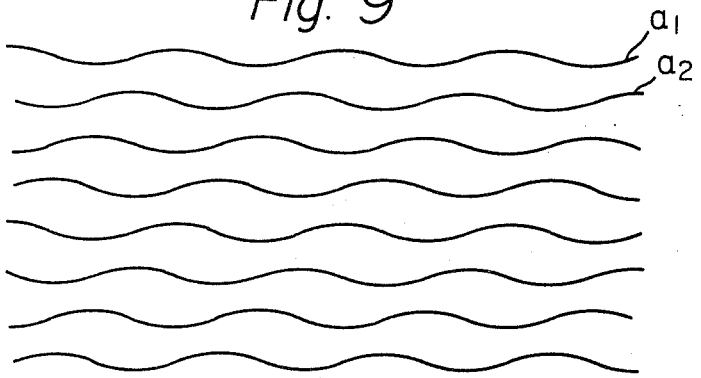
Figure 10:
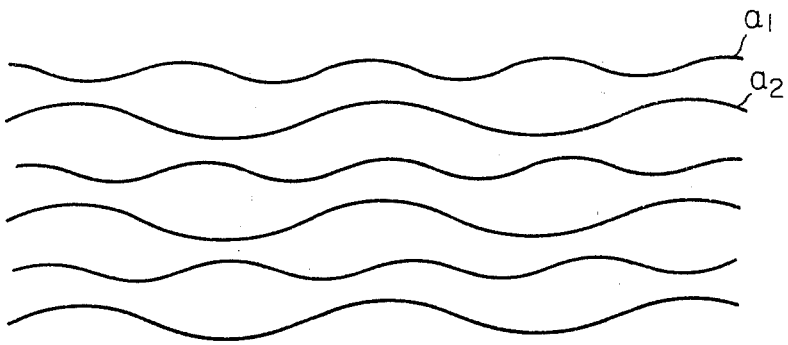
Figure 11:
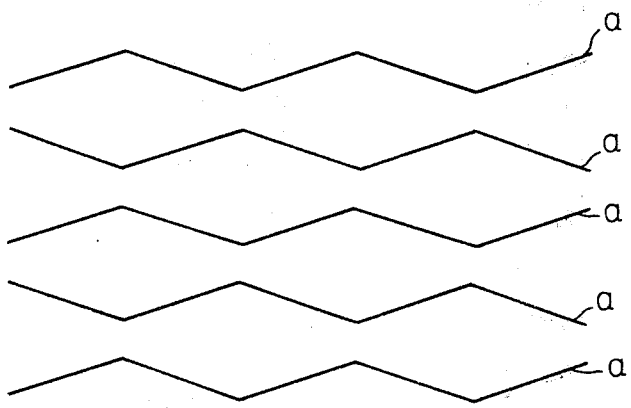
Figure 12:
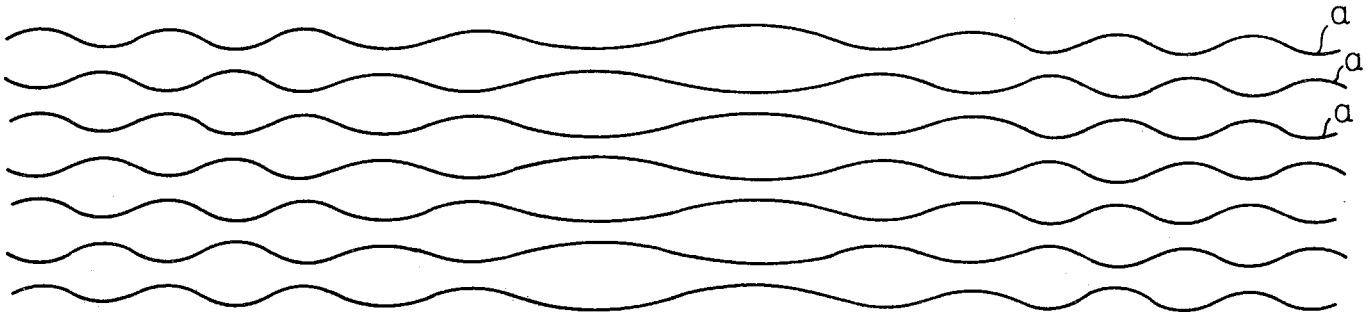
Figure 13:
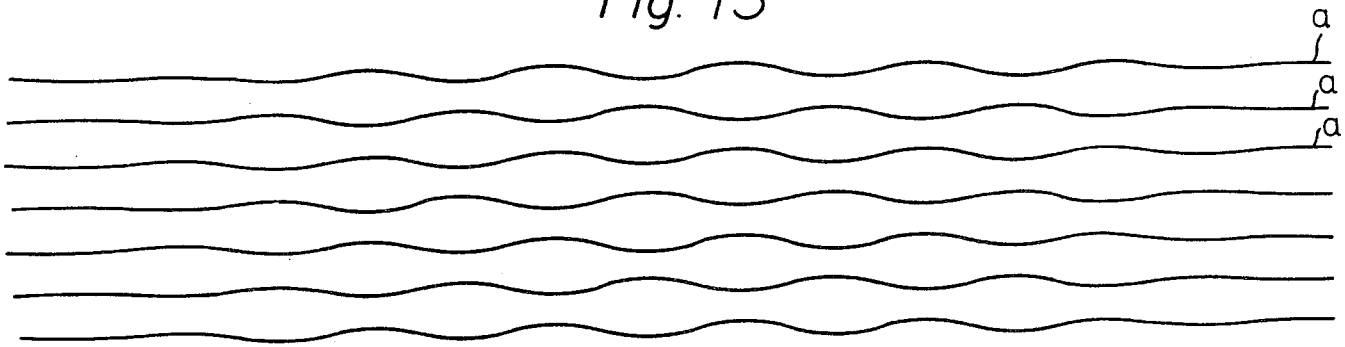
Figure 14:
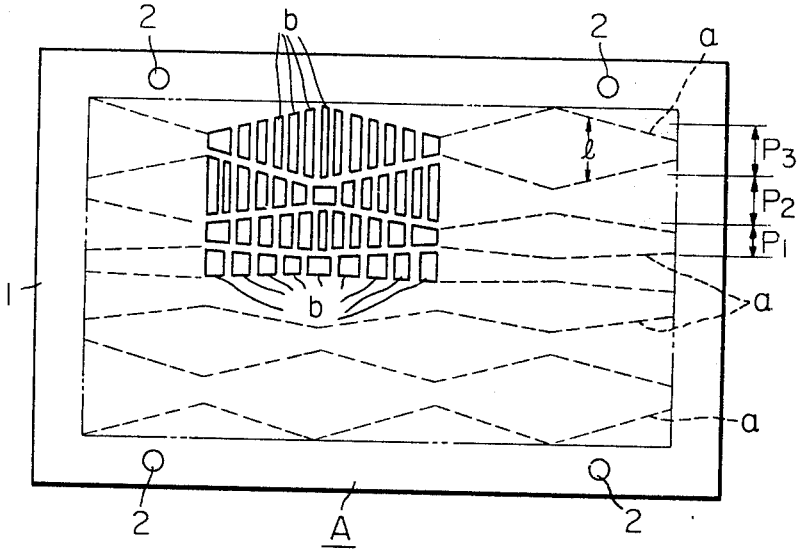
Figure 15:
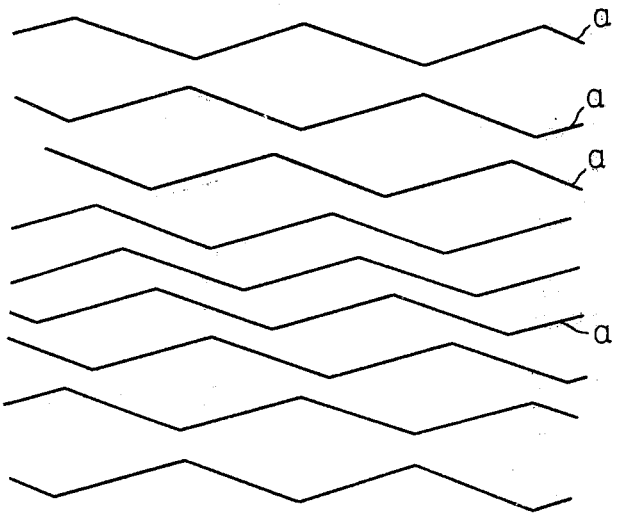
Figure 16:
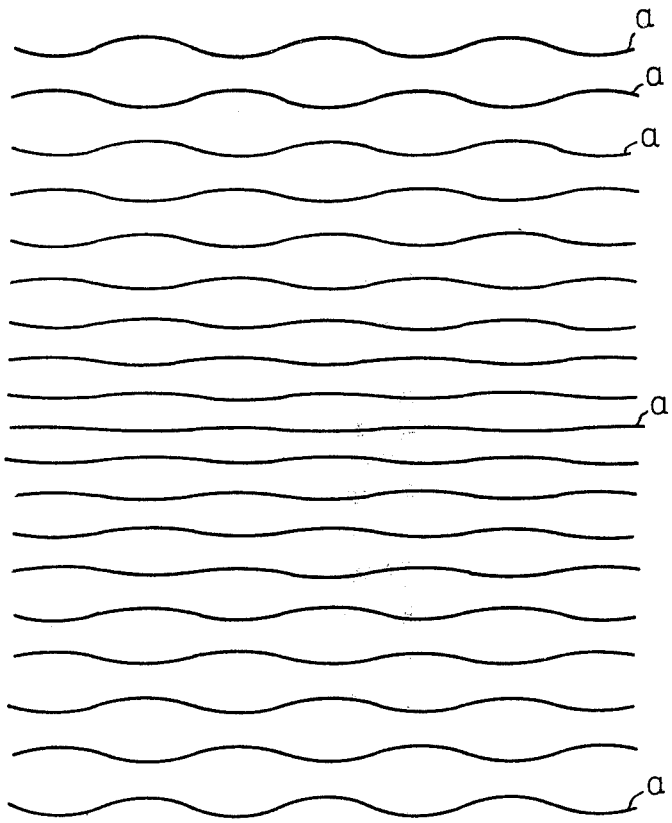
Figure 17:
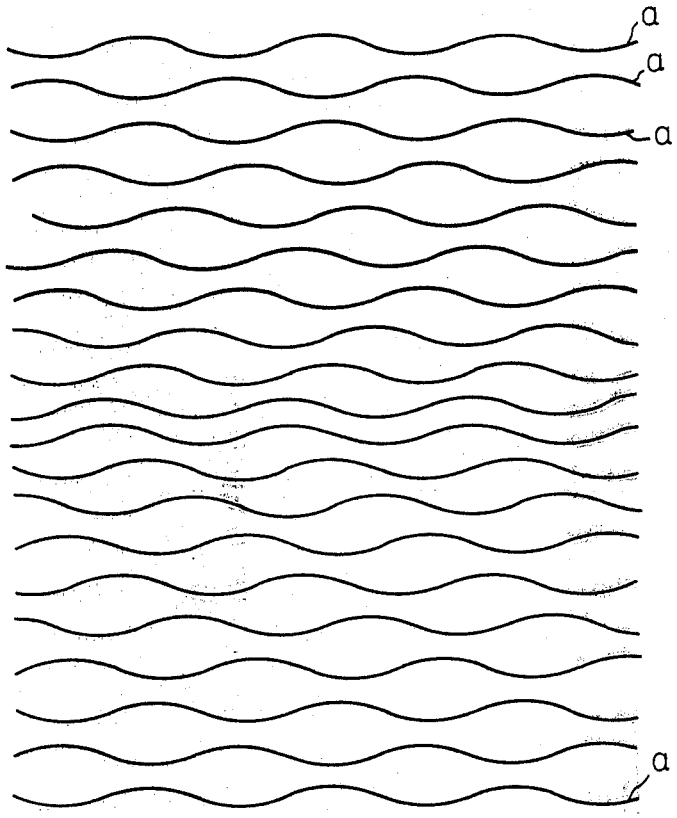

FIGS. 8 to 13 show modified embodiments of the wavy ribs. FIG. 8 is of an embodiment wherein the wavy ribs are of sine waves and the phases of the adjacent ones of wavy ribs $a_1$ and $a_2$ are deviated from each other by about 180°. FIG. 9 is of an embodiment wherein the phases of the wavy ribs of sine waves are deviated successively in turn by about 300° in the same manner as in FIG. 8. FIG. 10 is of an embodiment wherein the adjacent ones of wavy ribs $a_1$ and $a_2$ different in the amplitude, phase and angular velocity of the sine waves are arranged alternately. FIG. 11 shows an embodiment wherein the wavy ribs are of continuous bent straight lines. FIG. 12 is of an embodiment wherein the wavy ribs are made by varying the angular velocities of the sine waves in the X-axis direction. FIG. 13 is of an embodiment wherein the wavy ribs are made by varying the amplitudes of the sine waves in the X-axis direction. FIG. 14 shows an embodiment wherein a plurality of wavy ribs are so formed that the average spacing P between the adjacent ribs will be gradually larger toward the end edge from the center and many hair inlet holes are formed between the adjacent wavy ribs *a*. FIG. 15 is of an embodiment wherein the phases of the adjacent wavy ribs are deviated successively in turn from each other so that the spacing between the ribs will be larger toward the end edge from the center. FIGS. 16 and 17 are of embodiments wherein the wavy ribs are of sine waves, wherein FIG. 16 shows an embodiment in which the amplitude of the wave forms is made larger toward the end edge so that the spacing between the ribs will be larger and FIG. 17 shows an embodiment in which the phases of the adjacent wavy ribs are deviated successively in turn from each other so that the spacing between the ribs will be larger toward the outside.

According to the present invention, as has been described above, it is made possible to have hairs of different length introduced into the hair inlet holes by so forming the slit-shaped hair inlet holes that the length and width of each hole will be substantially inversely proportional to each other.

By forming the slit-shaped hair inlet holes so that, further, the hair holding angle defined by the side edge of the slit and the side edge of the inner blade will be constant always or at any positions, it is enabled to render the sharpness of the shaver to be even at all positions of the outer blade.

The hair cutting efficiency can be further improved by making the opened part area of the hair inlet holes to be at least 40% of the entire surface area of the outer blade.

As referred to in the above, the present invention has many excellent effects that there can be obtained an outer blade in which a number of hair inlet holes is formed to be present as mixed between the respective wavy ribs so that hair inlet holes of different lengths ranging from round holes to slits can be formed to be present as mixed on the entire blade surface, short and long hairs can be efficiently introduced, the cutting speed is high and the cutting efficiency is also high, that there can be made an outer blade in which, by inclining the direction of the hair inlet holes to be in a fixed direction with respect to the reciprocating inner blade, the holding angle for the hair can be made constant at an optimum value. Thus where the set of blades 4 extend transversely as shown in FIG. 4, the blade edges will bear a constant shallow angle, for example as indicated at $\alpha$ in FIG. 6, to the longitudinal edges of the closely spaced openings. Thus the cutting efficiency can be made uniform over the entire surface, there is simply obtained an outer blade favorable to the touch of the blade surface, the beard hairs freely selecting the optimum width of slit, without hurting the skin, by reason of the length of slit, and further there is obtained a net-shaped outer blade of a pattern high in opening rate and of tasteful design.

Further, according to the present invention, as there can be obtained an outer blade in which the rate of round holes and short slits is automatically high in the central part of the blade and the rate of long slits is high on the outside, the mechanical strength in the central part area which is most likely to be broken can be increased.

Further, according to the present invention, the area, i.e. the width × length, of each hole is substantially constant, the amount of the skin projected out of each hole will be uniform and, as a result, hairs will be able to be cut uniformly without hurting the skin.

What is claimed is:

1. An outer blade for an electric shaver in the form of a flat perforated thin metal plate of rectangular outline capable of being bent into "U" shape for cooperating with a cyclically moving set of interior blades of conforming profile for shearing beard hairs, the outer blade having a frame portion and a field portion, the field portion having generally longitudinally extending ribs extending along axes which are spaced generally parallel to one another, adjacent ribs defining between them respective series of closely spaced openings extending from rib to rib, the ribs being of wavy sinusoidal configuration with adjacent ribs being out of phase with one another so that the length of adjacent openings as measured from rib to rib differs, the length increasing and decreasing on a cyclical basis, and with a substantial difference in length between the longest openings and the shortest openings so that the longest openings are long enough to admit long beard hairs for shearing by the interior blades, adjacent ones of the closely spaced openings being of generally similar shape parallel to one another.

2. The combination as claimed in claim 1 in which adjacent ones of the closely spaced openings have parallel sides and in which the short openings are wider than the long openings so that the area of the openings is more nearly uniform.

3. The combination as claimed in claim 1 in which the ribs are of constant narrow width.

4. The combination as claimed in claim 1 in which the closely spaced openings are oriented at right angles to the rib axes.

5. The combination as claimed in claim 1 in which the closely spaced openings are slightly angled with respect to the rib axes, all of the openings being oriented in the same direction.

6. The combination as claimed in claim 3 in which the wavelength of the sinusoidal ribs varies along the rib axis.

7. The combination as claimed in claim 3 in which the wavelength of the sinusoidal ribs varies from one rib to the next.

8. The combination as claimed in claim 1 in which the openings comprise at least 40 percent of the field area.

9. The combination as claimed in claim 1 in which all of the ribs are of the same sinusoidal shape but with adjacent ribs being substantially opposite in phase so that the longest closely spaced openings in one series are opposite the shortest closely spaced openings in the adjacent series.

10. In an electric shaver, an outer blade and an inner blade assembly, the outer blade being in the form of a perforated thin metal plate, the outer blade having a frame portion and a field portion, the field portion having generally longitudinally extending ribs extending along axes which are spaced generally parallel to one another, adjacent ribs defining between them respective series of closely spaced openings extending from rib to rib, the ribs being of wavy sinusoidal configuration with adjacent ribs being out of phase with one another so that the length of adjacent openings as measured from rib to rib differs, the length increasing and decreasing on a cyclical basis, and with a substantial difference in length between the longest openings and the shortest openings so that the longest openings are long enough to admit long beard hairs for shearing by the interior blades, adjacent ones of the closely spaced openings being of generally similar shape and parallel to one another, the inner blade assembly being in the form of a reciprocated set of interior blades arranged in spaced parallel relation to one another and of "U"-shaped profile, the outer blade being bent into conforming profile, the closely spaced openings in the outer blade being so angled that the longitudinal edges thereof bear a constant shallow angle with respect to the edges of the interior blades.

* * * * *